United States Patent [19]

Rives

[11] Patent Number: 5,035,293

[45] Date of Patent: Jul. 30, 1991

[54] BLADE OR MEMBER TO DRILL OR ENLARGE A BORE IN THE EARTH AND METHOD OF FORMING

[76] Inventor: Allen K. Rives, 12211 Carols Way Cir., Houston, Tex. 77070

[21] Appl. No.: 581,557

[22] Filed: Sep. 12, 1990

[51] Int. Cl.[5] ..... E21B 10/46

[52] U.S. Cl. ..... 175/57; 175/410

[58] Field of Search ..... 175/57, 331-333, 175/406, 409, 410, 390-391

[56] References Cited

U.S. PATENT DOCUMENTS

| | | | |
|---|---|---|---|
| 3,346,060 | 10/1967 | Beyer | 175/410 |
| 4,244,432 | 1/1981 | Rowley et al. | 175/410 X |
| 4,630,694 | 12/1986 | Walton et al. | 175/391 |
| 4,640,375 | 2/1987 | Barr et al. | 175/410 |
| 4,717,290 | 1/1988 | Reynolds et al. | 407/34 |
| 4,796,709 | 1/1989 | Lynde et al. | 166/55 |
| 4,887,668 | 12/1989 | Lynde et al. | 166/55.8 |

FOREIGN PATENT DOCUMENTS

| | | | |
|---|---|---|---|
| 1239250 | 6/1986 | U.S.S.R. | 175/410 |

*Primary Examiner*—Thuy M. Bui

*Attorney, Agent, or Firm*—Jack W. Hayden

[57] ABSTRACT

A blade for a member that is supported on a rotatable well string to position the blade in operating position to engage and drill a well bore or enlarge a well bore. The blade has a bottom and side surface each with leading and trailing edges. Cutting elements extend along and terminate in the same plane as the leading bottom and side edges of the bottom and side surfaces; shock absorbers in the bottom surface extend below the bottom surface and cutting elements which shock absorbers are configured and spaced to form a non-continuous surface along and below the blade bottom surface to contact the earth ahead of the cutting elements to form annular spaced recesses or depressions in the earth so that when the cutting elements engage the earth, they do not contact a uniform earth extent or wall.

14 Claims, 2 Drawing Sheets

FIG.1
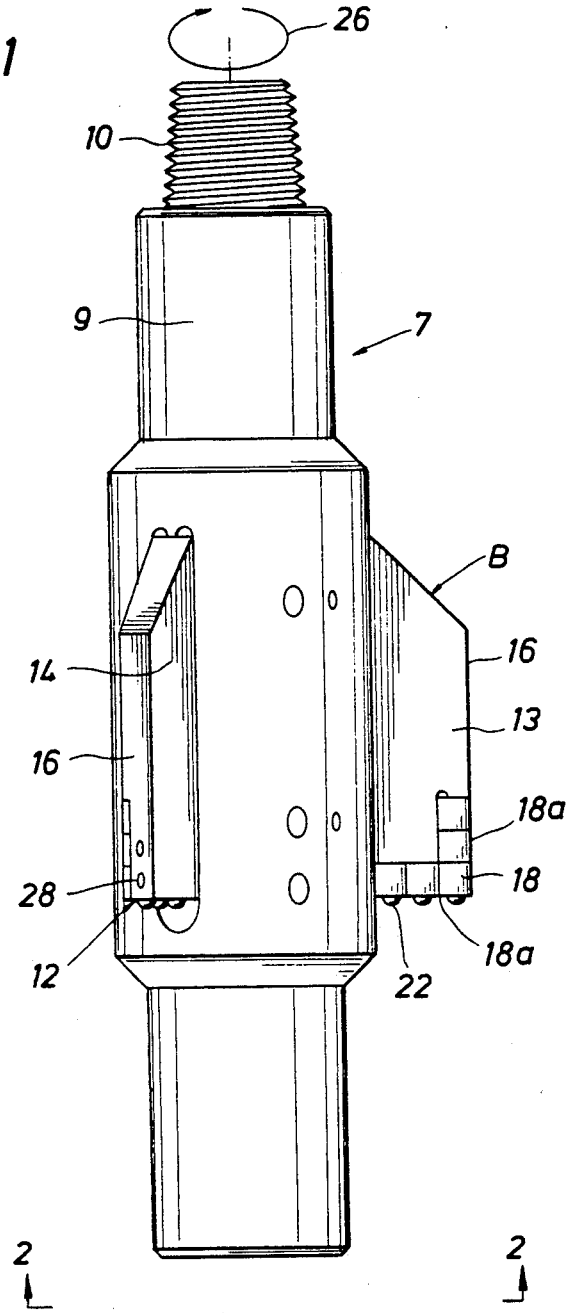
FIG.3
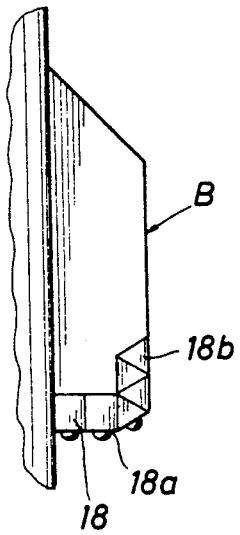
FIG.4
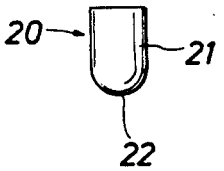
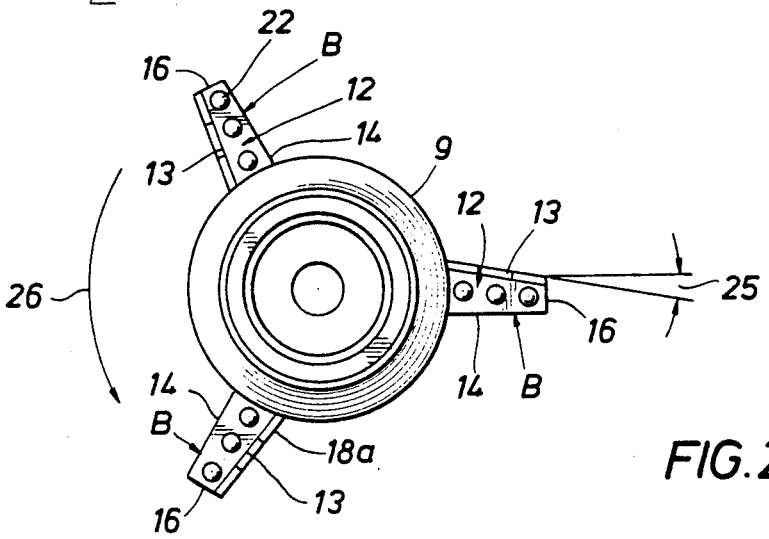
FIG.2

FIG. 5
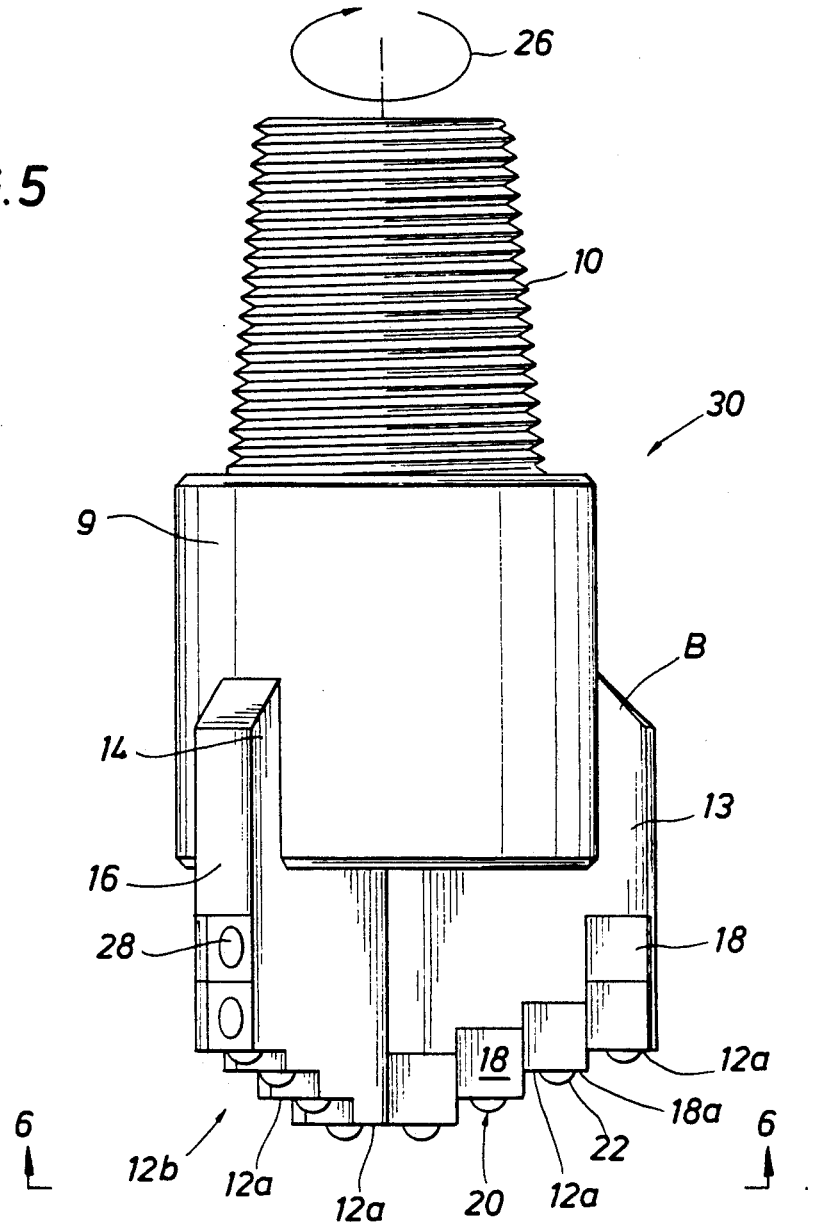
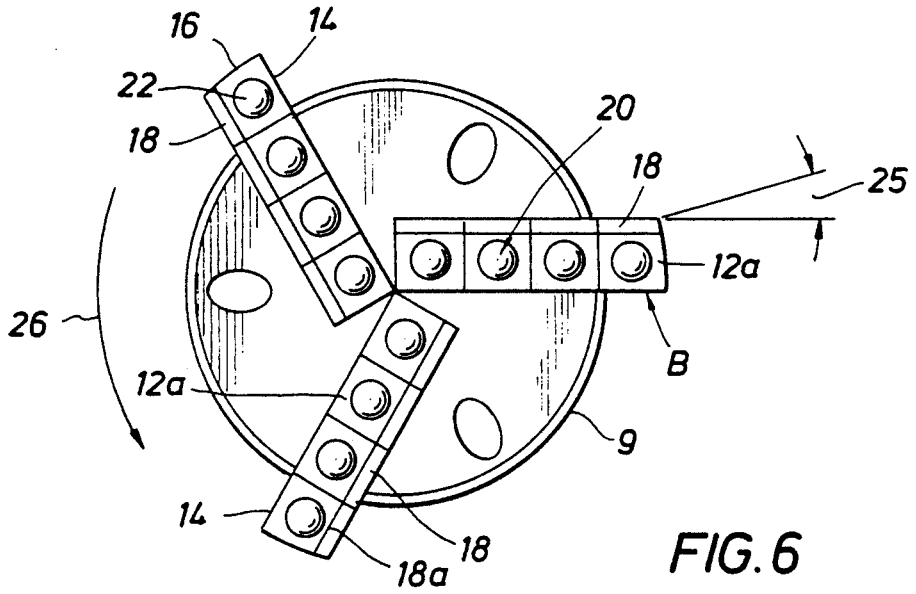
FIG. 6

BLADE OR MEMBER TO DRILL OR ENLARGE A BORE IN THE EARTH AND METHOD OF FORMING

STATEMENT OF THE PRIOR ART

Various devices are employed to drill or enlarge earth well bores. For example drill bits are employed to drill well bores. Hole enlargers, hole openers and underreamers are commonly employed for enlarging well bores from one size to another when so desired. Various types of drill bits, hole openers and underreamer constructions have heretofore been employed, and it is desirable that any of these tools remain in the well bore for as long as possible in operable condition to avoid the time lost and expense of retrieving them from the well bore and then replacing them and reentering the well bore to continue the enlarging operation.

Various types of cutting elements and arrangements have been employed to attempt to increase the life of the above mentioned devices, and such efforts have continues over a number of years. Substantial problems are still encountered because the various types of cutting elements or surfaces provided on the blades of the foregoing mentioned devices tend to wear rapidly or break due to the stress or load on the cutting elements as they encounter or engage and attempt to cut or remove the earth formation during drilling a well bore or the earth surrounding the well bore as it is being enlarged.

STATEMENT OF THE INVENTION

The present invention provides a relatively simple arrangement to assist in relieving stress on the cutting elements which extend along the leading edge of the bottom surface of blades by providing shock absorbers on the blade bottom surface which shock absorbers extend beyond or below the blade surface and cutting elements which are in opposed relation to the earth formation to be drilled or the earth surrounding the well bore portion to be enlarged. More specifically, the shock absorbers are arranged on the bottom surface of the blade in a particular relationship and have spheroidal end portions which project or depend downwardly below the blade bottom surface and the cutting elements along the blade bottom leading edge.

The shock absorbers are arranged so as to provide a non-continuous, interrupted surface in opposed relation to the earth formation to be drilled or the earth surrounding the well bore to be enlarged and are configured so as to form annular depressions or recesses in the earth contacted. This enables the shock absorbers to initially contact or drag on the opposed lateral soil surface during the drilling of the well bore or during the hole enlarging operation and form annular grooves or recesses therein prior to engaging the cutting elements with the earth as the member on which the blades are supported is rotated. The annular grooves or recesses provide interruptions in the soil surface which reduce the load or force on the cutting elements when the cutting elements later come in contact with the earth to be drilled or removed. This reduction in the amount of contact between the cutting elements and the earth formation not only assists in relieving the stress on the cutting elements positioned on the blades, but substantially increases their life. The increased life of the cutting elements enables them to be used longer so that the tool on which they are supported may remain in the well bore longer and remove additional earth footage before it becomes necessary to remove the rotatable member or tool from the well bore and replace the blades or replace the entire tool with new blades and new cutting elements and new shock absorbers thereon.

Other objects and advantages of the present invention will become apparent from a consideration of the following description and drawings.

BRIEF DESCRIPTION OF THE DRAWINGS

FIG. 1 is an elevational view illustrating one form of a hole enlarger with the present invention;

FIG. 2 is a bottom view on line 2—2 of FIG. 1;

FIG. 3 is an elevation of an alternate form of the blade and cutting elements of the present invention;

FIG. 4 illustrates one form of the shock absorber that may be employed with the present invention;

FIG. 5 is an elevational view of a drill bit with blades of the present invention; and FIG. 6 is a bottom view on the line 6—6 of FIG. 5.

DESCRIPTION OF THE PREFERRED EMBODIMENTS

Attention is first directed to FIG. 1 of the drawings wherein a device known as a hole opener is illustrated and referred to generally by the numeral 7. The invention will be described in detail in relation to the form of hole enlarging device, commonly called a hole opener, as illustrated in FIG. 1; however, it can be appreciated that the present invention may be used with an underreamer which also enlarges a bore in the earth. The invention may also be used with a drill bit to drill a well bore in the earth.

FIG. 1 shows a hole enlarger 7. It includes a longitudinally extending tubular member or body 9 which is provided at one end 10 with suitable threads for engaging with a well string to enable it to be lowered into a well bore for rotation to enlarge a well bore and removal from the well bore as desired or necessary. The tubular member 9 receives drilling fluids therethrough to be circulated into the well bore and then pumped out through the tool in a manner well known and then back to the earth's surface along with the cuttings resulting from the enlarging operation.

As illustrated in FIG. 2, the member 9 is shown as having three blade bodies B thereon, but such number is purely for purposes of illustration only. For example, when a hole opener is employed to enlarge a well bore from six inches to twelve inches, three blade bodies B may be employed but where the hole is to be enlarged from seventeen and one-half inches to twenty six inches, the number of blade bodies, by way of example only, may be at least five, but any other number may be employed to accomplish the desired results.

The member 9 as well as the blade bodies B are formed of any suitable high strength steel which is well known to those skilled in the art. The blade bodies B may assume any suitable configuration to accomplish the desired results but preferably include a bottom surface represented generally at 12 which, when the blade bodies B are positioned on the member 9 project or extend outwardly therefrom as shown. The blade bodies B also include a cutting or leading surface 13 and a trailing surface 14 spaced from surface 13 to provide a blade body of desired size and strength with generally longitudinally extending side surfaces 16 and bottom surfaces 12 of suitable thickness as illustrated in the drawings. The generally longitudinally extending side surface 16 is positioned or spaced outwardly of the member 9 as illustrated in the drawings when the blade bodies B are in proper relation to the earth around the well bore to be removed.

It can be appreciated that where an underreamer is employed, the blades may be mounted on the body so that they are recessed relative to the body as the underreamer is lowered into the well bore. When the well bore location is reached in which it is desired to drill an enlarged section, the blades are actuated in a manner well known to move them outwardly of the body and position them for engaging with the earth surrounding the well bore for enlargement thereof. In some underreamers, the blades are moved a full 90° relative to the longitudinal axis of member 9 before they are in proper position to initiate earth removal, and in other arrangements the blades move to less than 90° relative to the member 9 before they are in position to form the enlarged portion in the well bore. In such underreamers, the blades, when in operating position, have a bottom surface 12 in opposed relation to the earth formation to be removed as well as a longitudinally extending side surface 16 outwardly spaced from body 9 for enabling the present invention to perform as described herein.

Cutting elements 18 are positioned along the leading edge of the bottom surface 12 on the blade cutting surfaces 13 and extend at least partially along the leading edge of longitudinally extending side surfaces 16 as illustrated. The cutting elements 18 may assume any suitable configuration, but their outer edges 18*a* along the longitudinally extending leading edge of side surface 16 and along the leading edge of bottom surface 12 terminate in a plane coincident with the plane of the leading edge of surfaces 16 and 12 respectively. The cutting elements 18 are formed of any suitable well known hard material such as, by way of example sintered tungsten carbide or Polycrystalline Diamond and are well known in the art.

It will be noted that in FIGS. 1 and 2 the cutting elements 18 are illustrated as being rectangular in configuration, but if desired they may be of any suitable configuration such as, by way of example only, triangular in configuration as illustrated at 18*b* in FIG. 3. The cutting elements 18 are commonly available in one inch square or three quarter inch square shape as well as an isosceles triangle shape with a base of either one inch or three quarters inch. Other sizes and configurations may be employed, and the cutting element sizes or shapes need not be uniform along an edge. Any arrangement may be employed to group the cutting elements on the blade leading edges, and it is preferable that they be in substantially abutting or abutting relationship to each other as shown and that their outer edges which engage the earth form or present a continuous, uninterrupted surface to engage the earth to be removed.

Generally speaking, the cutting elements may be secured directly on the leading surface 13 of the blade bodies B or they may be mounted in recesses which are formed in the leading surface 13 of each blade body B in a manner well known in the art. The cutting elements, whether on the surface of the blade body or in recesses thereon are brazed or otherwise secured on the blade bodies B in a manner well known to those skilled in the art.

The bottom surface 12 of the blade bodies is provided with openings or holes therein in which are received shock absorbers 20. The shock absorbers are positioned and arranged along and on the blade bottom surface 12 to form a non-continuous, interrupted surface adjacent the formation which is in opposed relation thereto, which formation is to be removed by the cutting elements 18 on the longitudinal and bottom leading edge surfaces. The shock absorbers 20 may be formed by any suitable hard material and are preferably formed of sintered tungsten carbide which is commercially available. The shock absorbers may be positioned in the bottom surface 12 in any suitable manner such as by press fitting each shock absorber in a hole formed in bottom surface 12.

The shock absorbers are shown in FIG. 4 and may assume any configuration but are preferably round as illustrated at 21 preferably an ovid, or spherical end surface on one end 22, designated spheroidal herein. When the shock absorbers are press fitted in position in the holes in the bottom surface 12 the end surface 22 thereon projects down or depends from the bottom surface 12 of the blade body and below the outer or lower edge surface 18*a* of the cutting elements 18 as more clearly illustrated in FIG. 1 of the drawings. Preferably, the spheroidal end portion of the shock absorbers projects beyond the bottom surface 12 of the blade body and beyond the outer or lower edge 18*a* of the cutting elements 18 in the range of approximately 0.005 inches to 0.100 inches, and the preferred extension is approximately 0.060 inches.

The size range of the shock absorbers 20 is preferably in the diameter range of approximately one-quarter of an inch to approximately five-eighths of an inch and the preferred embodiment diameter is approximately seven-sixteenths of an inch. While the number of shock absorbers per cutting element may vary, it is preferred to use at lest one shock absorber per cutting element.

The spacing of the shock absorbers to form a non-continuous surface as illustrated in the drawings may be expressed in terms of their diameter in relation to their longitudinal centerline axis. The preferred range of spacing of the shock absorbers relative to their longitudinal centerline axis is approximately one times the shock absorber diameter to approximately three times the shock absorber diameter and the preferred spacing is approximately two times the shock absorber diameter. The length of the shock absorber 20 is not critical, but it should be of suitable length so that when it is press fitted in the hole in the bottom surface 12 of the blade body B it will be maintained in position throughout its period of use. As noted, the exposed end surface 22 of the shock absorber 20 adjacent the bottom of the hole is preferably spheroidal.

The spacing and arrangement of the shock absorbers on the bottom surface 12 positions the spheroidal surface 22 to provide the non-continuous, interrupted surface along bottom surface 12 to first contact the earth formation to be removed which is in opposed relation to the bottom surface 12 and such interrupted, non-continuous surface provided by the shock absorbers form spaced annular recesses or depressions in the generally lateral portion of the earth formation surrounding the well bore as the member 9 is rotated by the well string which supports the member 9 in the well bore. The spaced annular recesses or depressions are thus present in the earth formation to be removed when the cutting elements thereafter contact such earth. By providing a non-continuous, interrupted earth formation adjacent the bottom surface 12 of the blades, the cutting elements thereon are better able to withstand shock loading by the earth to be removed. This arrangement relieves the stress applied to the cutting elements 18 when they thereafter engage with the earth formation and substantially increases the operating life of the hold enlarging device, whether it be a hole opener or an underreamer. Testing of the present invention demonstrates that it increases life of the cutting elements 18 by two hundred to three hundred percent which enables the member 9 to remain in use a corresponding length of time and remove a corresponding greater amount of earth surrounding a well bore than heretofore possible before replacing the blades, or cutting elements, or shock absorbers or entire tool.

Some customers prefer not to have a sharp corner where the bottom surface 12 and longitudinal side surface 16 of the blade B meet which requires that the corner be cut non-square such as circular or at an angle. FIG. 3 of the drawings illustrates cutting elements **18*b* of triangular configuration as being positioned along the longitudinal leading edge 16 of the blade body as well as at the juncture of the bottom leading surface 12 and the longitudinally extending leading side surface 16. If desired, the triangular cutting elements also may be employed along the bottom leading edge adjacent the bottom surface 12 of the blade. In such event, the bases of the triangular cutting elements 18*b* would be co-planar with the bottom surface 12 as they are with the longitudinal side surface 16 as illustrated in FIG. 3** of the drawings, as they are in the other cutting element shapes and arrangements.

It will be noted that FIG. 2 illustrates one arrangement of the blade bodies B on the member 9. In such arrangement the blades are spaced equidistant circumferentially of member 9 and leading surface 13 is in a trailing relationship relative to the longitudinal axis of the tubular member 9 with respect to the direction of rotation of member 9. The preferred relationship of the blades to the member 9 provides a trailing angle represented at 25 between the forward surface 13 and direction of rotation 9 of member that is in the range of approximately 5° to approximately 20° and the preferred embodiment of the trailing angle of surface 13 is approximately 10°. In FIGS. 1 and 2 the arrow 26 illustrates the normal direction of rotation of member 9 and blades B. It can be seen that the longitudinal plane of surface 13 is in trailing relationship to the centerline longitudinal axis of member 9 by the angle 25. Of course, it can be appreciated that if desired the blades may be positioned at other than a trailing relationship relative to the member 9.

At noted, the shock absorbers 20 abrasively remove or depress the portion of the opposed earth formation surface they contact and form spaced annular recesses or grooves on the exposed surface of the earth adjacent the well bore to be enlarged prior to contact with the substantially continuous surface presented by the lower or bottom edges of cutting elements 18 along the bottom leading edge of blades B. The annular recesses formed by the shock absorbers 20 provide a non-continuous earth surface or formation adjacent the leading edge of the cutting elements 18 and makes it easier for the cutting elements to cut the earth around the bore and thereby substantially increase the useful downhole life of the tool. Generally speaking, the cutting elements 18 wear out before the protruding shock absorbers 20 and when the tool is retrieved even after use, the shock absorbers, even though worn, still project beyond the cutting elements which are worn more than the shock absorbers.

Also, it is generally desirable to provide at least several members 28 formed of sintered tungsten carbide or other suitable hard material in the longitudinal side surface 16 of the blade body B preferably in the blade portion near the intersection of longitudinal side surface 16 and bottom surface 12 which members have flat ends that terminate in a plane coincident with the plane of the longitudinal side surface 16 to assist in maintaining the desired gauge on the enlarged bore portion as the tool is operated. Such gauge members are employed in a similar relationship not only on the blade generally longitudinal side surface of hole openers but also on the blade longitudinal side surface of underreamers and drill bits.

FIGS. 5 and 6 illustrate the present invention employed with a drill bit and corresponding parts bear corresponding numbers. The preferred embodiment of the blades B is illustrated in the drawings and it will be noted that the blade bottom surface includes a plurality of surface portions **12*a* which are in different lateral planes to form a sequentially stepped surface represented by the numeral 12*b*. Preferably, one cutting element is provided for each bottom surface portion 12*a* as shown in the drawings. However, the number of cutting elements, or their configuration may vary per each surface portion 12*a* as desired. It will also be noted that one shock absorber 20 is preferably provided per each cutting element 18 and per each surface portion 12*a*. It can be appreciated that the lateral extent of the surfaces 12*a* may be such that it may be desirable to use more than one cutting element 18 per surface 12*a*, and in such event it is preferred to employ at least one shock absorber 20 per each cutting element 18 provided on the surfaces 12*a*. The surface portions 12*a* are each shown as preferably extending substantially perpendicular to the longitudinal centerline axis of member 12, but under some conditions it may be desirable that some, or all extend at an angle to the centerline axis of member 9**.

It is to be further noted that the surfaces **12*a* are arranged or formed so that the surface portion 12*a* on each blade B immediately adjacent the longitudinal centerline axis of member 9 are at the lowest elevation or lateral plane in relation to the lateral plane of each of the other surface portions 12*a* relative to the centerline axis of member 9 as shown in FIG. 5 of the drawings. This arrangement provides a stepped configuration wherein the bottom surface represented by 12*b* of each blade extends in a general angle that is inclined upwardly and outwardly relative to the centerline axis of member 9. The configuration could be reversed so that the highest elevation of lateral surfaces 12*a* relative to the centerline axis of member 9 is adjacent the longitudinal centerline axis of member 9 and the other surface portions 12*a* are at sequentially lower lateral planes relative to the centerline axis of member 9. In this form the bottom blade surface 12*b* forms a general angle that extends generally outwardly and downwardly relative to the centerline axis of the member 9**.

It is preferred that the hole openers such as hole enlargers and underreamers have a bottom surface portion 12 as illustrated in FIG. 1 of the drawings, but there may be some circumstances where the configuration could be other than that shown.

The present invention may be formed by forming a blade of any suitable configuration to be received or used with a hole opener, drill bit or underreamer as desired. As previous noted, if the blades are to be used with an underreamer, they may be mounted so as to pivot from a retracted position outwardly relative to member 9 to position them in operating position to engage the earth formation surrounding a well bore and enlarge the well bore as desired. Such general constructions are well known in the art.

The blade of the present invention is formed of any suitable thickness of material and is provided with a bottom surface to project or extend outwardly of the member and a longitudinally edge which is spaced outwardly of the body when the blade is in operating position. The bottom surface 12 as well as the longitudinally extending side surface 16 may be provided with holes in any suitable manner such as by a drill press or the like whereupon the shock absorbers may be press fitted therein to depend or project from the bottom surface of the cutting elements as hereinabove described. The holes in side surface 16 of the blades B are of sufficient depth so the flat ends of members 28 terminate in the plane of the generally longitudinally extending side as described herein. The holes are preferably slightly smaller than the size of members to be received therein to assist in assuring they will not fall out or be jarred loose during use.

In employing the present invention, the blades B may be positioned on the body of the tool to be used to enlarge the hole by any suitable means such as welding or the like, or they may be otherwise mounted or supported on the member 9 of the tool in manner well known in the art to enable them to be moved to operating position. The member of tool is then secured in the well string and the well string is lowered into the well bore to the desired elevation for performing the desired operation of enlarging the well bore by rotating the tool using a well string. The shock absorbers first engage and form the annular ridges or depressions in the earth surface adjacent the bottom surface of the blades which depressions prevent the earth from forming a continuous wall or surface adjacent the cutting elements which extend along the bottom surface of the blade and thereby relieve the stress on such cutting elements and substantially extend their life.

The foregoing disclosure and description of the invention are illustrative and explanatory thereof, and various changes in size, shape and materials as well as in the details of the illustrated construction may be made without departing from the spirit of the invention.

What is claimed is:

1. A blade for mounting on a member to be supported on a rotatable well string to position the blade in operating position to drill or enlarge a well bore in the earth upon rotation of the well string and member, said blade including:

a blade body;

said blade body having a bottom surface with leading and trailing edges for projecting outwardly of said member when in operating position;

said blade having a side surface with leading and trailing edges for extending generally longitudinally and in spaced relation to the member when in operating position;

cutting elements on said blade along said bottom leading edge and at least partially along said side leading edge, said cutting elements terminating in substantially the same plane as said blade bottom and side surfaces; and shock absorbers on said blade bottom surface, said shock absorbers being spaced relative to their longitudinal centerline axis to form a non-continuous surface which projects below said cutting elements and below said blade bottom surface to engage the earth ahead of the cutting elements to form annular recess in the earth contacted.

2. The blade of claim 1 wherein said shock absorbers are sintered tungsten carbide elements with an end portion which extends below said cutting elements and below said blade bottom surface in the range of approximately 0.005 inches to approximately 0.100 inches and wherein said shock absorbers are spaced along said blade bottom surface in relation to their longitudinal centerline axis within the range of approximately one times their diameter to approximately three times their diameter.

3. The blade of claim 2 wherein said shock absorbers are substantially round sintered tungsten carbide elements within the diameter range of approximately one-quarter of an inch to approximately five-eights of an inch and wherein said end portion of said shock absorbers are spheroidal; and wherein said blades have sintered tungsten carbide elements extending at least partially along a longitudinally extending side surface of said blades and which are co-terminus with the plane of said longitudinal side surface of said blades to assist in maintaining gauge.

4. The blade of claim 1 wherein said blade bottom surface extends at approximately 90° relative to the longitudinal axis of said member on which it is to be supported.

5. The blade of claim 1 wherein said blade bottom surface is stepped which forms a generally upward and outward angle in relation to the longitudinal axis of said member on which said blade is to be supported.

6. The blade of claim 1 wherein said blade bottom surface is stepped which forms a generally downward and outward angle of relation to the longitudinal axis of said member on which said blade is to be supported.

7. A device for connecting in a rotatable well string to rotate the device when it is in operating position to drill or enlarge a bore in the earth comprising:

a member;

a plurality of blades supported on said member;

said blades having a bottom surface with leading and trailing edges for projecting outwardly relative to said member when in operating position to enlarge the bore;

said blades having a longitudinally extending side surface with leading and trailing edges for extending generally longitudinally and in spaced relation to the member when in operating position;

cutting elements on said blades along said bottom leading edge and at least partially along said side leading edge, said cutting elements terminating in substantially the same plane as said blade bottom and side surface; and shock absorbers on said blades bottom surface, said shock absorbers being spaced relative to their longitudinal centerline axis to form a non-continuous surface which projects below said cutting elements and below said blade bottom surface to engage the earth ahead of the cutting elements to form annular recesses in the earth contacted.

8. The device of claim 7 wherein said shock absorbers are sintered tungsten carbide elements with an end portion which extends below said cutting elements and below said blade bottom surface in the range of approximately 0.005 inches to approximately 0.100 inches and wherein said shock absorbers are spaced along said blade bottom surface in relation to their longitudinal centerline axis within the range of approximately one times their diameter to approximately three times their diameter.

9. The device of claim 8 wherein said shock absorbers are round sintered tungsten carbide elements within the diameter range of approximately one-quarter of an inch to approximately five-eights of an inch and wherein said end portion of said shock absorbers are spheroidal; and said blades having sintered tungsten elements extending at least partially along a longitudinally extending side surface of said blades and which are co-terminus with the plane of said longitudinal side surface of said blades to assist in maintaining gauge.

10. The device of claim 7, or 8, or 9 wherein the cutting elements on said leading edge of said blades is in a trailing relationship relative to the direction of rotation of the device in relation to the centerline of the longitudinal axis of the member in the range of approximately 5° to approximately 20°.

11. A method of forming a blade with cutting elements and shock absorbers thereon for positioning on a rotatable member to be supported on a well string to position the blade in operating position to drill or enlarge a bore in the earth, comprising the steps of:

forming the blade with a bottom surface having a leading and a trailing edge which extends outwardly relative to the member when in operating position and a longitudinally extending side surface with a leading and a trailing edge for extending in spaced relation to the body when the blade is in operating position;

forming spaced holes in the bottom surface of the blade;

securing the cutting elements along the bottom leading edge of the blade and at least partially along the adjacent longitudinally extending leading edge of the blade to terminate substantially in the plane of the bottom and side surfaces; and positioning shock absorbers in the spaced holes with a spheroidal end thereon extending below the blade bottom surface and the cutting elements.

12. The method of claim 11 wherein the holes in the blade bottom surface are spaced so that the shock absorbers when positioned therein are spaced relative to their longitudinal centerline axis to form a non-continuous surface projecting below the blade bottom surface and the cutting elements.

13. The method of claim 11 wherein the holes in the blade bottom surface are of a depth so that the shock absorbers positioned therein project in the range of approximately 0.005 inches to approximately 0.100 inches below the blade bottom surface;

wherein the shock absorbers are generally round sintered tungsten carbide buttons within the diameter range of approximately one-quarter of an inch to approximately five-eights of an inch;

wherein the shock absorbers are each positioned on the blade bottom surface in a hole and spaced in relation to their longitudinal axis within the range of approximately one times their diameter to approximately three times their diameter; and wherein openings are formed in the longitudinally extending side surface of the blade to receive sintered tungsten carbide elements which terminate in the plane of the longitudinal side surface to assist in maintaining gauge.

14. A method of drilling or enlarging a well bore in the earth by removing earth with a rotating member having circumferentially spaced blades with a bottom surface providing a bottom leading edge thereon with cutting elements along the bottom leading edge, and with shock absorbers in the bottom surface having a spheroidal end portion depending below the bottom surface and cutting elements, the shock absorbers defining an interrupted surface extending along and below the blade bottom surface for contacting the earth to be removed, comprising the steps of:

lowering the rotating member into the well bore and positioning it so that the shock absorbers defining the interrupted surface are in position to contact the earth to be removed;

lowering the member and rotating it so that the shock absorbers contact the earth formation ahead of the cutting elements; and forming annular spaced depressions or recesses within the contacted earth to be removed by the shock absorbers ahead of contact by the cutting elements with the earth to be removed to assist in reducing the strain on the cutting elements.

* * * * *